US005411182A

United States Patent [19]

Marte et al.

[11] Patent Number: 5,411,182

[45] Date of Patent: May 2, 1995

[54] DISPENSING DEVICE FOR VISCOUS MATERIALS

[75] Inventors: Gonzolo U. Marte, Metro Manila, Philippines; Maria H. G. Herrera; Federico H. Saa, both of Valle, Colombia; Maria E. H. Cequera; Leopoldo J. S. Gonzalez, both of Valencia, Venezuela; Orlando Fuquen, Somerset, N.J.

[73] Assignee: Colgate-Palmolive Co., New York, N.Y.

[21] Appl. No.: 47,523

[22] Filed: Apr. 19, 1993

[51] Int. Cl.[6] ..... B67D 5/42

[52] U.S. Cl. ..... 222/386; 222/405

[58] Field of Search ..... 222/319, 330, 386, 405, 222/249; 100/116; 118/264; 15/257.05; 206/77.1, 204

[56] References Cited

U.S. PATENT DOCUMENTS

| | | | |
|---|---|---|---|
| 344,447 | 6/1886 | Johnston | 222/386 |
| 557,014 | 3/1896 | Osgood | 215/257.05 |
| 688,259 | 12/1901 | Muller | 222/386 |
| 1,014,294 | 1/1912 | Garvey | 222/386 |
| 1,065,823 | 6/1913 | Matthews . | |
| 1,107,989 | 8/1914 | Oestreich | 100/116 |
| 1,353,104 | 9/1920 | Wetsler | 215/231 |
| 2,601,940 | 7/1952 | Marcellus | 222/205 |
| 2,763,405 | 9/1956 | Shvetz | 222/320 |
| 2,939,162 | 6/1960 | Kravitt | 15/257.05 |
| 3,244,333 | 4/1966 | Kahn et al. | 222/386 |
| 3,838,955 | 10/1974 | Dubbeld | 425/84 |
| 4,427,125 | 1/1984 | Tuitt | 215/231 |
| 4,566,148 | 1/1986 | Rolin | 15/257.05 |
| 4,831,681 | 5/1989 | Puder | 15/257.05 |
| 5,148,951 | 9/1992 | Moure et al. | 222/386 |

FOREIGN PATENT DOCUMENTS

| | | | |
|---|---|---|---|
| 276700 | 2/1965 | Australia | 222/386 |
| 4118225 | 12/1992 | Germany | 222/319 |
| 394945 | 9/1931 | United Kingdom | 222/386 |

*Primary Examiner*—Andres Kashnikow
*Assistant Examiner*—Philippe Derakshani
*Attorney, Agent, or Firm*—Michael J. McGreal; Robert C. Sullivan

[57] ABSTRACT

A dispensing device for gels and other viscous materials includes a container containing the gel or viscous material and a dispenser. The dispenser has a substantially planar structure and includes a plurality of raised areas and recessed areas. The raised areas include a plurality of holes defining dispensing outlets for the viscous material. The dispenser rests on the surface of the viscous material so that a downward pressure applied to the dispenser forces the viscous material through the dispensing outlets. The recessed areas collect excess water and debris to prevent contamination of the viscous material within the container. The raised areas may be in the form of concentric annular ring shaped areas or elongated radially disposed raised areas which extend outwardly from the center of the dispenser toward the outer edge. The outermost edge of the dispenser may include a plurality of flexible tabs which contact the side wall of the container as the contents of the container are consumed. The recessed areas can be complementary to recessed areas in the bottom of the container and fit into the recessed areas in the bottom of the container.

17 Claims, 4 Drawing Sheets

DISPENSING DEVICE FOR VISCOUS MATERIALS

FIELD OF THE INVENTION

The present invention relates to a dispensing device for delivering or dosing a quantity of a viscous material from a container. The invention is furthermore directed to a device for delivering the viscous material without contaminating the supply of the viscous material with dirt, water or other debris.

BACKGROUND OF THE INVENTION

Viscous compositions in the form of cleaning and skin care products have increased in popularity in recent years due in part to the reduced amount of packaging needed for the compositions which are typically in the concentrated form. In particular, there has been a recent increase in the interest of viscous hard surface cleaners and specifically dish washing detergents and hand soaps. These viscous compositions are often in the form of thick pastes, gels, lotions and slurries which can be easy to use but are sometimes difficult to dispense. The conventional dispensing devices for these viscous compositions include squeeze bottles having a dispensing outlet or wide mouth open jars and containers.

The flexible squeeze bottles are effective for dispensing quantities of certain compositions but have the disadvantage of allowing the viscous material to slump to the bottom of the bottle. It can then become difficult to dispense the composition when only a small amount remains in the bottle. Furthermore, the viscous nature of the composition allows it to adhere to the sides of the bottle thereby increasing the difficulty of dispensing the remaining material.

Open wide mouth containers typically require the user to directly place the fingers or implement such as a sponge, dish cloth, or facial towel into the viscous composition. The composition adheres to the fingers or implement so that it can be applied to the intended surface. This method of dispensing the viscous composition often results in an uncontrollable amount of the composition adhering to the fingers or implement. This is particularly so where the composition is very thick or sticky such that the thickness of the composition on the fingers or implement is thick regardless of the amount of pressure applied to the composition. Furthermore, dirt or other material on the fingers or implement can be transferred to the container thereby contaminating the remaining portion of the composition.

Efforts have been made to overcome the above-noted disadvantages of dispensing viscous materials. One example is disclosed in U.S. Pat. No. 5,148,951 to Moure et al. The disclosed dispensing package includes a container for the product and a dispensing sheet that rests on and adheres to the surface of the product. The dispensing sheet is a flexible, resilient sheet material that is sufficiently flexible to conform to the shape of the container. A plurality of holes are included in the dispensing sheet. In use, one applies pressure to the dispensing sheet to force the material through the holes. This device, however, is not entirely effective in that an overpressure can be easily applied to the dispensing sheet resulting in an excessive amount of material being dispensed. In addition, water, dirt or other debris from the finger or implement can be transferred to the dispensing sheet which will ultimately result in contamination of the material remaining in the container.

There is accordingly a continuing need for a dispensing container for delivering a controlled amount of a viscous material without adulteration of the material in the container.

SUMMARY OF THE INVENTION

The disadvantages and limitations of the previous dispensing devices are obviated by the present invention while providing a convenient and efficient means for delivering a controlled amount of the viscous material from the container.

Accordingly, a primary object of the invention is to provide a dispensing device for use with gels and other viscous materials for delivering a controlled amount of the material.

The dispensing device of the invention is a substantially rigid plate-like member. The device is generally made from a plastic material by thermoforming or extrusion molding processes. In embodiments of the invention, the device is sufficiently rigid so that when a dispensing pressure is applied to the device, the pressure is distributed to a high degree across the dimensions of the device. The device will be slightly flexible to enable the device to yield under high applied pressure.

The dispensing device of the invention is used in conjunction with a container which contains the viscous material. The container is preferably a wide mouth jar or carton to enable the user's fingers or other implement to be easily inserted into the container. The dispensing device is a substantially non-planar plate-like disk member having outer dimensions corresponding substantially to the upper dimensions of the container. The plate-like member includes raised areas and recessed areas. The raised areas are provided with a plurality of spaced-apart dispensing outlets. The raised areas and recessed areas preferably will be complementary to the shape of the bottom of the container with recesses in the dispenser disk fitting into recesses in the bottom of the container and raised areas of the bottom of the container fitting into raised areas of the dispenser disk. The dispensing device rests directly on top of the viscous material so that pressure applied to the device causes the viscous material to extrude through the dispensing outlets. The viscous material is then removed from the surface of the dispensing device by the user's fingers, a cloth, or other implement. Any water, dirt or other debris transferred to the dispensing device is collected and retained in the recessed areas so as not to contaminate the viscous material in the container. The recessed areas further provide a floatation means for the device. This is in part the result of spreading the applied force across the surface of the viscous material. If necessary, the dispensing device can be removed, cleaned and replaced on the viscous material. It also can be transferred from one container to another.

The raised areas of the dispensing device may be in any form such as one or more concentric circles which define annular raised areas containing the dispensing outlets. The peripheral edge of the device may contain a plurality of outwardly extending bendable legs to contact the inner wall of the container to position the dispensing device while resting on the viscous material. In preferred embodiments, the portions adjacent the container wall are sufficiently flexible to bend when in contact with the wall of the container and allow the dispensing device to conform to the inner dimensions of the container as it moves downwardly in the container. They also can be shaped to grip the sidewall of the container.

As noted above, a preferred embodiment is where the dispenser disk has the same shape as the bottom of the container. This provides for full usage of the product in the container since the dispenser disk will contact essentially the full bottom surface. The raised and recessed areas of the dispenser disk can be of essentially any shape or pattern, it only being necessary that they be complementary to the shape of the bottom of the container and fit into the bottom of the container.

In alternative embodiments, the dispensing device has a circular shape having an annular raised area centrally located in the device and a plurality of radially extending raised areas. Each of the raised areas include a plurality of dispensing outlets. The dispensing outlets in the radially extending raised areas progressively increase in size toward the peripheral edge of the device. In further embodiments of the invention, the dispensing device has a substantially rectangular shape which is preferably used in conjunction with a rectangular shaped container. In this embodiment, the dispensing device includes a plurality of recessed areas which may be concentric circles to define concentric raised areas having a plurality of dispensing outlets. Alternatively, the recessed areas are provided to define raised areas which extend radially outward toward the peripheral edge of the device. The radially extending raised areas also include a plurality of dispensing outlets.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

Referring to the drawings which form a part of this original disclosure.

DETAILED DESCRIPTION OF THE INVENTION

Figure 1:
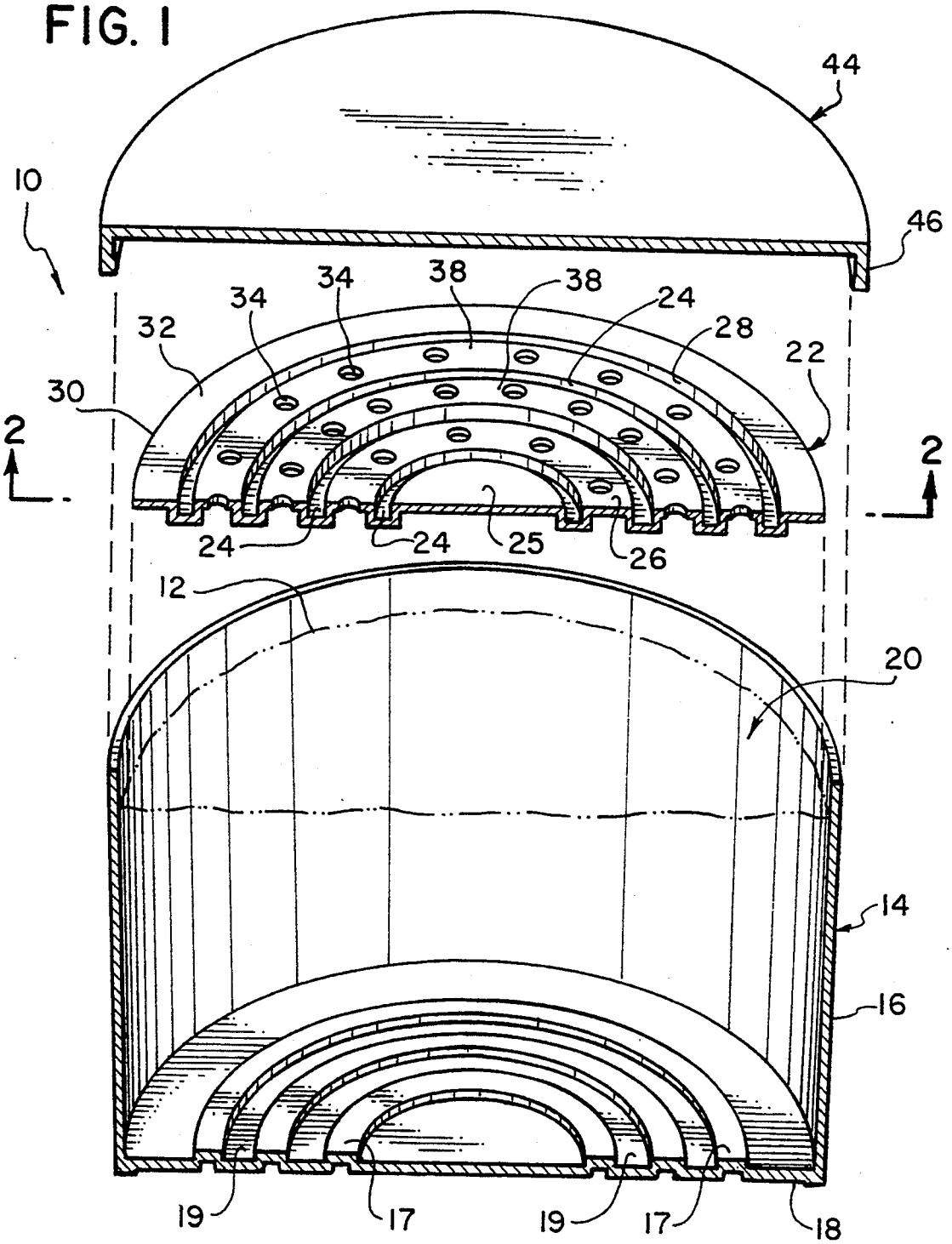
FIG. 1 is a cross-sectional view of the dispensing device and container in accordance with the present invention illustrating the concentric recessed areas and raised areas of the dispensing device and the complementing raised and recessed areas of the container.

The present invention is directed to a dispensing device for use in conjunction with a viscous material and in particular gel-type hard surface cleaners. Referring to the drawings, the dispensing device 10 is adapted to rest on the surface of the viscous material 12 within a container 14.

Broadly, the viscous material may be a hard surface cleaner or detergent, facial cleaning composition, skin care cosmetic, polish and the like. In preferred embodiments, the viscous material is a semi-solid gel, cream or lotion. Alternatively, the viscous material can be a paste or high consistency slurry. The viscous materials should be semi-solid at room temperature and should not liquefy during normal use of the material. The viscosity of the material should be sufficiently high to resist spilling if the container is overturned without inhibiting the dispensing of the material through the dispensing device as discussed hereinafter in greater detail. In preferred embodiments, the viscous material will have a consistency similar to conventional gel-type hand cleaners.

The hard surface cleaning compositions in gel form are known in the art. Gel-type hard surface cleaners often contain a mixture of anionic surfactants, cationic surfactants, polyhydric alcohols, and inorganic salts and a dispersing agent. Optional builders and chelating agents are often included in the detergent compositions. A suitable translucent gel composition can include an alkyl ether sulfate, potassium pyrophosphate, water and a solvent.

As shown in FIG. 1, the container 14 includes a slightly tapered side wall 16 and a bottom wall 18. The side wall 16 defines an open upper end 20 slightly greater than the bottom wall 18. In preferred embodiments, the side wall 16 is slightly tapered toward the bottom 18 of the container and the open upper end 20 is dimensioned to allow easy access to the contents of the container. In alternative embodiments, the side wall may be substantially vertical such that the open upper end has the same dimensions as the bottom wall.

In the embodiment of FIG. 1, the container is round as defined by the tapered side wall 16. Alternatively, the container may be oval, rectangular or square. When the container has a rectangular or square shape, it is desirable to provide the container with rounded corners to allow the contents of the container to be easily removed from the corners. The height of the side wall of the container will depend on the specific composition within the container and the desired volume. In preferred embodiments, the height of the side wall allows easy access to the bottom of the container by the fingers or other implement.

The bottom wall 18 of the container in the embodiment shown in FIG. 1 is of a shape complementary to that of the dispensing device 10. That is, the dispensing device will fit snugly onto the bottom of the container with raised areas of the container bottom fitting into raised areas in the dispensing disk. This bottom shape of the container will provide greater strength and stability to the container.

The container 10 can be made from any suitable material including, for example, plastic, metal or paperboard. In preferred embodiments, the container is made from a thermoplastic material which is molded according to conventional practices. The container can be produced by thermoforming techniques or injection molding as known in the art. Suitable plastic materials include high density or low density polyethylene, polypropylene, polyester, polyvinylchloride, polyvinylidenechloride, polystyrene and polycarbonate. Alternatively, the container can be formed from laminates of paper and metal foils or plastic materials.

Figure 2:
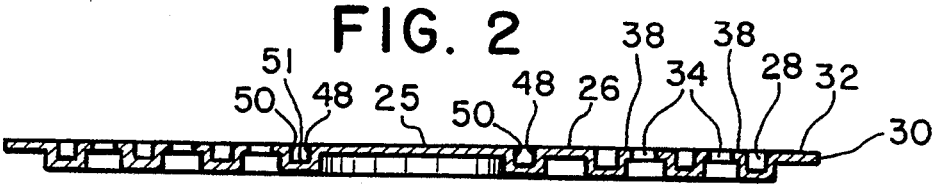
FIG. 2 is a top view of the dispensing device as taken along line 2—2 of FIG. 1.

In the first embodiment of the invention as shown in FIGS. 1 and 2, the dispensing device 10 is a substantially circular plate-like disk. A plurality of recessed areas 24 and 28 are arranged as concentric annular rings. As shown in FIG. 2, the recessed areas 24 and 28 forming the rings have substantially the same width and depth. The central area 25 is recessed a distance slightly less than the recesses 24,28. The recessed rings 24,28 are spaced apart to define raised areas 26,38 in the form of concentric annular rings. The recesses are formed with vertical, curved or angled side walls and a bottom wall. The outermost recessed ring 28 is spaced from the outer edge 30 of the disk 22 to define an outwardly extending annular lip 32. As shown in FIG. 2, the annular lip 32 is in substantially the same plane as the raised areas 26. The height of the raised areas over the recessed areas will range from about 1/64" to ⅛", and preferably 1/32" to 1/16 inch.

A plurality of dispensing outlets 34 are provided in the raised areas 26 and extend completely through the plate 22. As shown in FIG. 1, the dispensing outlets 34 are in the form of apertures which are uniformly spaced apart around each of the raised areas 26,38. The dimension and number of the dispensing outlets included in the raised area will depend in part on the dimensions of the dispensing device, the nature of the viscous material in the container and the intended amount of the viscous material to be dispensed. In one embodiment of the invention where the viscous material has a consistency similar to a conventional gel-type hand cleaner, the dispensing outlets 34 are circular apertures having a diameter of about 4 millimeters. In the embodiment shown in FIG. 1, three concentric raised areas are provided where each includes a plurality of uniformly spaced apart dispensing outlets. In this embodiment, the dispensing outlets in the two outermost concentric raised rings 38 are spaced about 20° apart. The innermost raised ring 26 is provided with the dispensing outlets spaced about 40° apart. The arrangement of the dispensing outlets and the raised areas provide a controlled and regulated dispensing of a gelled hard surface cleaner.

An optional lid 44 as shown in FIG. 1 may be provided to close the container 14. The lid 44 preferably includes a lip 46 to form a snap connection between the lid and the upper edge of the side wall 16 of the container 14. In alternative embodiments, the lid may be hinged to the container in a conventional manner.

In use, the container 16 is filled with an appropriate viscous material 12 such as a gel-type hand cleaner and the dispensing device 10 is placed directly on the viscous material with the raised areas 26,38 facing upward. In preferred embodiments, the dimension of the dispensing device 10 is substantially the same as the inner surface of the side wall 16 so that the dispensing device fits neatly within the container and can rest on the surface of the viscous material without interference from the side walls of the container which will inhibit downward movement of the device as the level of the viscous material decreases when the material is consumed. As shown in FIG. 2, the recessed areas 24, 28 provide buoyancy to the dispensing device so that the device will float on the surface of the viscous material. There also is a sufficient rigidity so that the dispensing device does not deflect downwardly to any significant degree to then deliver the material in the container from only one region of the container. The arrangement of the raised and recessed areas and the dispensing outlets cooperate to regulate the amount of the viscous material dispensed with each application and to provide more uniform delivery from the container. The viscous material within the container is dispensed through the dispensing outlets 34 by applying a slight downward pressure to the upper surface of the dispensing device 10 by the fingers of the user or by an implement such as a sponge, dish cloth or brush. The downward pressure on the dispensing device forces the viscous material upward toward the raised areas and through the dispensing outlets 34. The viscous material passing through the dispensing outlets are removed by contacting the fingers or other implement. During normal use, the fingers of the user or the implement will be wiped across the surface of the dispensing device to pick up a desired amount of the viscous material.

The dispensing device, in preferred embodiments, is only slightly flexible so that a localized dispensing pressure when applied to the dispensing device will transfer a substantially uniform pressure downwardly on to the viscous material to force the material upwardly through essentially each of the dispensing outlets. Minimizing the flexibility of the dispensing device will prevent the device from collapsing or sinking into the viscous material in the area where the pressure is applied. The slightly flexible texture of the dispensing device will also prevent the device from collapsing or folding when a wiping motion is applied to the device to remove the material from the raised surfaces. The raised areas and the recessed areas provide a corrugated reinforcing structure to strengthen the device to provide for this benefit.

The recessed areas 24 and raised areas 26 of the dispensing device 10 are defined by side walls 48 and 50 extending between a bottom wall 51 and the raised areas 26 as shown in FIG. 1. The height of the walls 48 and 50 define the depth of the recessed areas 24. The corners of the wall and the raised area and bottom wall are preferably rounded as shown in FIG. 1. The bottom wall and the raised areas may also be slightly rounded. The depth of the recessed areas 24 is preferably sufficient to provide the buoyancy of the dispensing device to prevent the device from sinking into the viscous material.

The recessed and raised areas cooperate with the side walls to form reinforcing or stiffening members for the disk such that the disk has a slightly corrugated cross-section. The vertical or near vertical side walls provide a gripping surface for the disk to keep the disk on the top of the material to be dispensed. It will be appreciated that the side walls lying in a different plane from raised or recessed areas function as the stiffening members.

The dimensions of the recessed areas 24 in preferred embodiments is sufficient to collect an effective amount of water, dirt or other debris which might be transferred from the fingers or other implement to the dispensing device during a wiping motion across the face of the dispensing device. By collecting the excess water, dirt or other debris in the recessed areas, contamination of the viscous material within the container is substantially avoided. When an excessive amount of debris is collected in the recessed areas, the dispensing device can be removed from the container and cleaned to remove the debris. The dispensing device can then be returned to the container and the viscous material.

The bottom side of the dispensing device has a profile the same as the top surface defined by the recesses and raised areas. In preferred embodiments as shown in FIG. 1, the bottom wall 18 of container 14 has a plurality of raised areas 17 and recessed areas 19 complementing the shape of the dispensing device. As the contents of the container are consumed, the dispensing device will rest neatly in the raised and recessed areas of the container to enable essentially complete dispensing of the contents.

Figure 3:
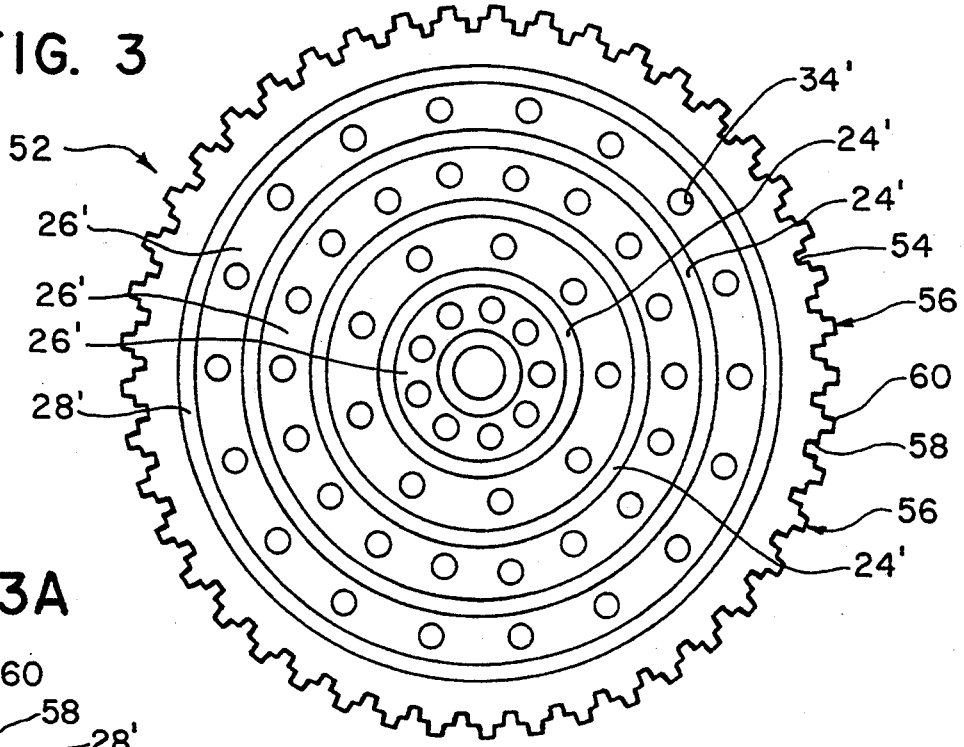
FIG. 3 is an elevational view of a further embodiment of the invention showing the concentric raised areas and recessed areas and the outwardly extending flexible tabs.

Referring to FIG. 3, an alternative embodiment of the invention is illustrated. In this embodiment, the dispensing device 52 is constructed in a similar fashion to that shown in FIG. 1, except for the outer edge. Otherwise, the dispensing device operates in a similar manner to the dispensing device 10. In FIG. 3, elements similar to those shown in FIG. 1 and FIG. 2 are designated by the same reference numeral with the addition of a prime.

As shown in FIG. 3, the dispensing device has a substantially circular disk-like shape having four concentric recessed areas 24' which define four spaced-apart, concentric raised rings 26'. A plurality of holes defining dispensing outlets 34' are uniformly spaced around each of the raised areas. Each of the raised areas 26' are disposed in the same plane to define an upper surface while each of the recessed areas are disposed in a second plane to define a lower surface of the dispensing device. The difference in height of the recessed areas will be about 2.2 mm to 10 mm and preferably about 0.5 mm to 5.0 mm.

An outer annular lip 54 extends radially outward from the dispensing device and is disposed in the same plane as the raised areas 26'. The annular lip 54 includes a plurality of uniformly spaced-apart tabs 56. Each of the tabs 56 are defined by a first planar portion 58 extending radially outward from the lip 54 and a second planar portion 60 depending from the first portion 58.

Figure 3A:
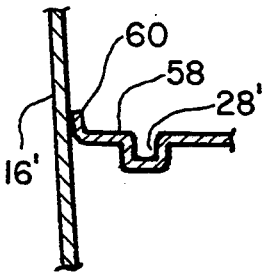
FIG. 3A is a partial cross-sectional side view of the embodiment of FIG. 3 showing the flexible tabs bending against the wall of the container.

In the embodiment of FIG. 3, the dispensing device is preferably formed from a slightly resilient plastic material which is sufficiently rigid to prevent the device from folding or bending during use. The plastic material is further sufficiently flexible to allow the tabs 56 to bend when in contact with the walls of the container. These tabs will provide a gripping onto the container sidewall to keep the dispensing device on the product surface. The dispensing device 52 is particularly suitable for use in a container having slightly tapered walls. Preferably, the dimension of the dispensing device 52 is substantially the same as the inner dimension of the upper edge of the container so that when the container is full, the outer edges of the tabs 56 make minimal contact or are slightly spaced from the wall of the container. As the contents of the container are consumed, the dispensing device will move downwardly with the level of the viscous material. As shown in FIG. 3A, the flexible tabs 56 will contact the side wall of the container and bend upwardly to permit the dispensing device to rest on the surface of the viscous material. The tabs 56 enable the dispensing device to be centered in the container, minimize any gap between the outer edge of the dispensing device and the container wall, and permit the dispensing device to grip the container sidewall.

Figure 4:
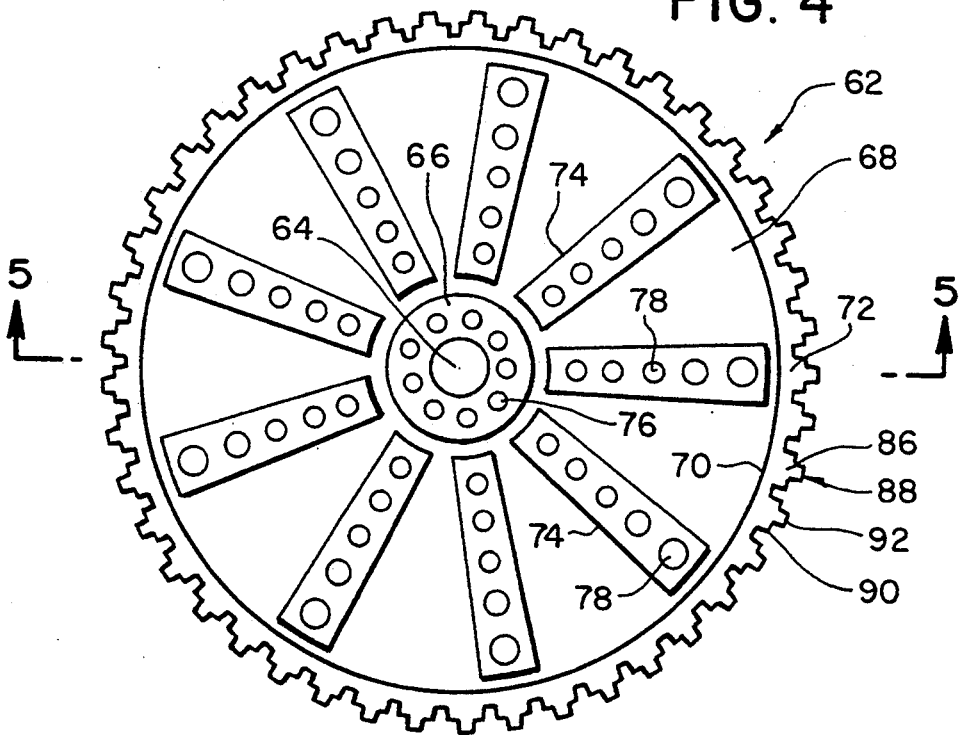
FIG. 4 is an elevational view of a further embodiment of the invention showing the central, annular raised area and the radially extending raised areas and flexible tabs extending radially outward.

In a further embodiment of the invention illustrated in FIG. 4, the dispensing device comprises a circular plate-like member 62. In this embodiment, a central circular recessed area 64 is encircled by an annular raised ring 66. An outer recessed area 68 extends from the raised annular ring 66 radially outward to a vertical wall 70. A depending lip 72 extends radially outward from the upper edge of the vertical wall 70. A plurality of radially disposed raised areas 74 extend from the central annular raised ring 66 toward the outer wall 70. As shown in FIG. 4, the radial raised areas 74 are spaced a small distance from the central annular ring 66 and from the outer vertical wall 70. The annular raised ring 66 is provided with a plurality of uniformly spaced holes 76 to define the dispensing outlets. In preferred embodiments, the holes 76 are of a uniform size. A plurality of holes 78 are provided in each of the radial raised areas 74 to define dispensing outlets. As shown in FIG. 4, the holes 78 are progressively larger toward the outer edge of the dispensing device. In alternative embodiments, the holes 78 may be of a uniform size.

The depending annular lip 70 depends from the upper edge of the vertical wall 70. The annular lip 70 includes a plurality of spaced-apart tabs 88 defined by a first planar portion 90 and a second planar portion 92. As shown in FIG. 4, the second planar portion 92 has a width less than the width of the first planar portion 90. In use, the dispensing device is placed in a container on the surface of the viscous material so that the material is dispensed through the holes 76 and 78 by applying a downward dispensing pressure on the upper surface of the dispensing device. The tabs 88 are sufficiently flexible so that they will bend when contacting the wall of the container in a fashion substantially as in the embodiment shown in FIG. 3A.

Figure 5:
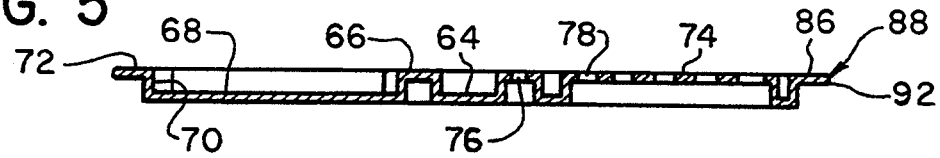
FIG. 5 is a cross-sectional view of the dispensing device taken along line 5—5 of FIG. 4 showing shallow recesses and curved edges.

FIG. 5 is a cross-sectional view of the dispensing device of FIG. 4 showing the annular raised ring 66, each of the radial raised areas 74 and the outer annular lip 72 being in substantially the same plane. The central recess 64 and the second outer recessed area 68 are also shown to be in substantially the same plane.

The operation of the dispensing device 52 is substantially the same as in the previous embodiments. The dispensing device 62 is placed in a container with the viscous material such that the bottom surface rests on the surface of the viscous material. A downward pressure is applied to the dispensing device by the fingers of the user or by an implement to force the viscous material upward through the holes 76 and 78 defining the dispensing outlets. The viscous material is removed from the dispensing device by contacting the upper surface or by a wiping motion. As in the previously discussed embodiments, the recessed areas 64 and 68 are dimensioned to collect excess water and debris from the fingers or implement contacting the upper surface of the dispensing device. Since the dispensing outlets are provided in the raised areas, the water and debris cannot flow into the viscous material thereby contaminating the material within the container.

Figure 6:
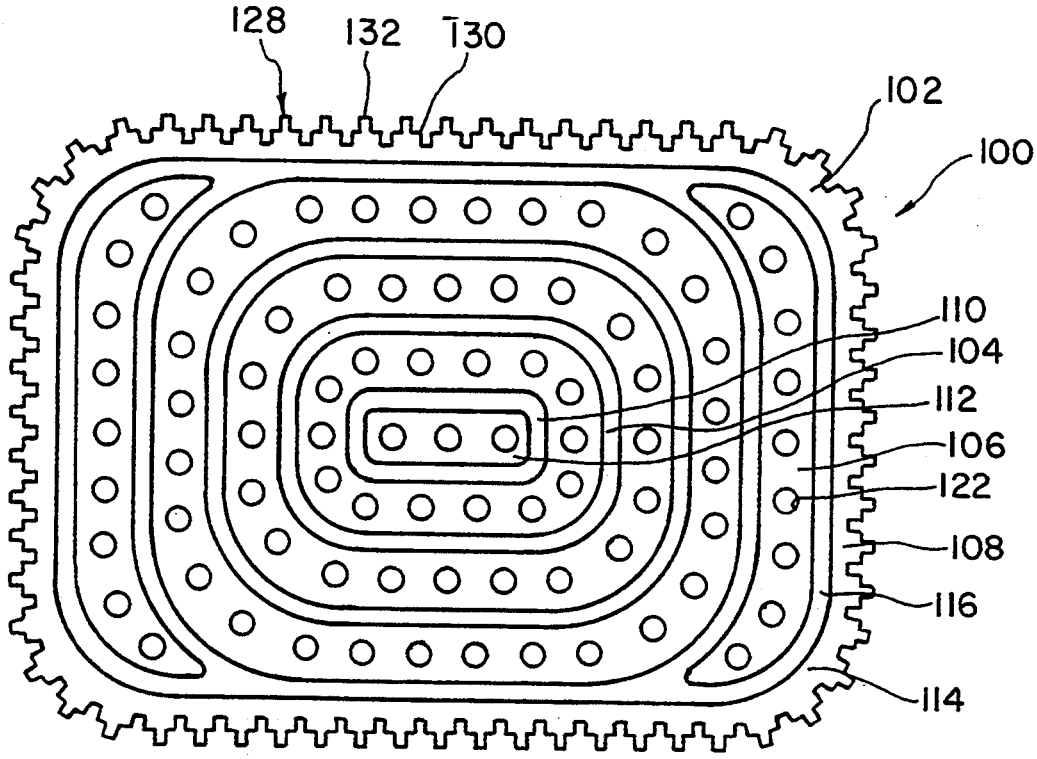
FIG. 6 is an elevational view of the dispensing device in accordance with a further embodiment of the invention having a substantially rectangular shape and a plurality of concentric recessed areas showing the flexible legs extending outwardly from the rectangular shaped dispensing device.

In a further embodiment of the invention as shown in FIG. 6, the dispensing device 100 has a substantially rectangular shape. The corners 102 of the dispensing device are slightly rounded to accommodate the rounded corners of a rectangular shaped container which contain the viscous material. In this embodiment, the dispensing device 100 comprises a plurality of recessed areas 104 which define a plurality of raised areas 106. The recessed areas are substantially concentric with the peripheral edge 108 so that the raised areas 106 have a substantially rectangular shape corresponding to the shape of the dispensing device. The innermost recessed area 110 defines an elongated raised area 112 centrally located within the dispensing device. The outer edge 108 defines an outwardly extending lip 114 disposed in the same plane as the raised areas 106. The outermost recessed area 116 defines a discontinuous raised area 118 at each of the minor sides of the rectangular shaped dispensing device. A plurality of uniformly spaced holes 122 are provided in each of the raised areas to define dispensing outlets for the viscous material.

In the embodiment shown in FIG. 6, the dispensing device 100 is formed with the outer lip 114 having a plurality of tabs 128. The tabs 128 extending from the lip 114 are defined by a first planar portion 130 and a second planar portion 132 depending from the first planar portion 130. The second planar portion 132 has a width that is less than the width of the first planar portion 130. The dispensing device 100 is preferably formed from a resilient plastic material such that the tabs 128 are able to flex and fold upward when in contact with the wall of the container.

Figure 7:
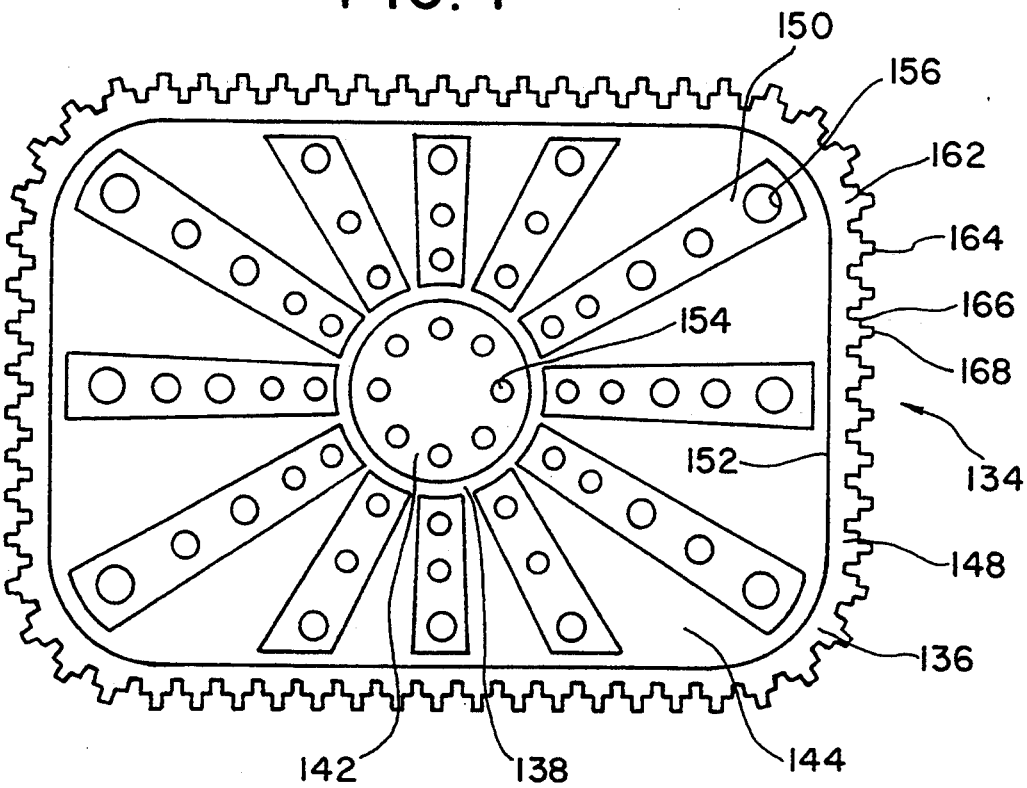
FIG. 7 is an elevational view of a further embodiment of the invention showing the dispensing device having a substantially rectangular shape and radially extending raised areas and flexible legs extending outwardly.

In a further embodiment as shown in FIG. 7, the dispensing device 134 has a substantially rectangular shape with slightly rounded corners 136. A circular recessed area 138 is centrally located in the dispensing device 134. The recessed area 138 defines an annular raised area 142. An outer recessed area 144 extends from the annular recess 138 toward the outer edge of the dispensing device. The outer recess 144 terminates a short distance from the outermost edge to define an outwardly extending lip 148. A plurality of raised areas 150 extend radially from the annular recess 138 toward the outer edge and terminate a short distance from the outer wall 152 of the recessed area 144. A plurality of holes 154 are uniformly spaced in the annular raised area 142 to define dispensing outlets for the viscous material. A plurality of holes 156 are arranged radially along each of the radial raised areas 150. As shown in FIG. 7, the holes 156 are of different sizes and become incrementally larger toward the radial edge 158 of the radial raised areas 150. Each of the holes 156 in the raised areas 150 define dispensing outlets for the viscous material.

In the embodiment shown in FIG. 7, the dispensing device 134 is formed with the outer lip 148 having a plurality of tabs 164. Each of the tabs 164 is defined by a first planar portion 166 and a smaller second planar portion 168. The dispensing device 134 is preferably formed of a plastic material such that the tabs 164 are sufficiently flexible to bend when in contact with the outer wall of a container.

Figure 8:
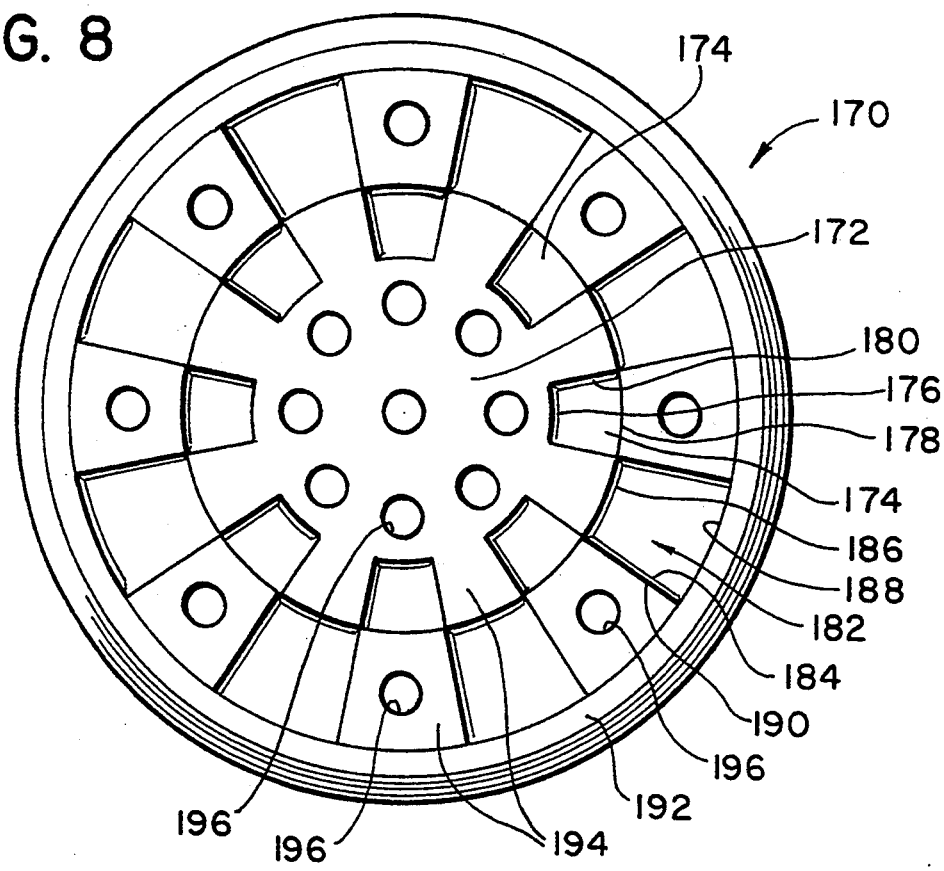
FIG. 8 is an elevated view of a further embodiment showing a dispensing device having concentrically arranged recessed areas.

In a further embodiment shown in FIG. 8, the dispenser 170 has a substantially circular shape with a circular raised center area 172. A plurality of spaced-apart recessed areas 174 are arranged in a ring concentric to the center area 172. As shown in FIG. 8, the recessed areas 174 have substantially arcuate inner edges 176, arcuate outer edges 178 and radial side edges defined by side walls 180. A second concentric ring of spaced-apart recesses 182 are arranged around the first ring of recesses 174 and staggered with the recesses 174. The outer recesses 182 also have side walls 184 defining arcuate inner and outer edges 186,188 and radial edges 190. The outer recesses 182 terminate at a radially extending lip 192. In the embodiment shown, the bottom walls of the recesses are in the same plane. The remaining areas 194 between the recesses 174 and 182 define raised areas and are in the same plane as the center area 172. A plurality of dispensing outlets 196 are provided in the center area 172 and the raised areas 194. The side walls defining the recesses 174 and 182 form the strengthening ribs for the dispenser.

Figure 9:
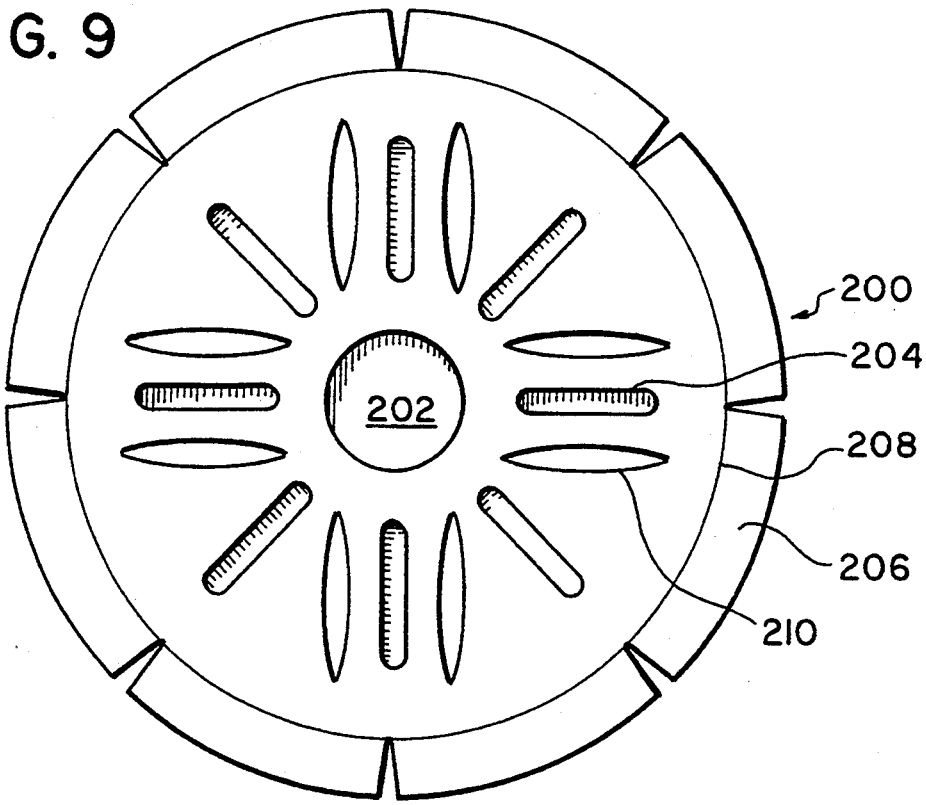
FIG. 9 is an elevated view of a further embodiment of the dispensing device showing the flexible edge and elongated dispensing outlets.

In another embodiment illustrated in FIG. 9, the dispenser 200 includes a circular recess 202 disposed in the center. A plurality of elongated recessed areas 204 extend radially outward from the center of the dispenser. Between each recessed area 204 is an elongated dispensing outlet 210. The outer edge of the dispenser terminates at a plurality of flexible tabs 206 connected to the dispenser along fold or hinge lines 208. During use, the tabs 206 are able to bend to enable the dispenser to fit within the tapered walls of the container.

The dispensing devices shown in the FIGS. 7–9 function substantially the same as the embodiment of FIG. 1. Basically, the dispensing devices are placed on the surface of a viscous material contained within a container having a shape corresponding substantially to the shape of the dispensing device. During use, a dispenser pressure from the users fingers or other implement is applied to the upper surface of the dispensing device. The downward pressure forces the viscous material upward through the dispensing outlets where it is removed by the fingers or implement. Excess water and debris from the fingers or implement are collected in the recessed areas so as not to contaminate the contents of the container. In the embodiments of FIGS. 6 and 7 the container has slightly tapered walls so that the fingers contact the side walls to center the dispensing device within the container. As the level of the viscous material within the container is lowered, the fingers bend upwardly when in contact with the walls of the container to allow the dispensing device to rest on the surface of the viscous material.

While advantageous embodiments have been illustrated, it will be understood by those skilled in the art that various changes and modifications can be made therein without departing from the scope of the invention as defined in the appended claims.

What is claimed is:

1. A dispensing device for dispensing a quantity of viscous material from a container having a bottom and sidewalls, said device comprising:

a substantially non-planar dispenser disk for positioning on said viscous material, said dispenser disk having a plurality of flotation means and having a plurality of dispensing outlets extending through said disk for said viscous material;

the flotation means comprising a plurality of recessed areas and the dispensing outlets comprising a plurality of raised areas.

2. The dispensing device according to claim 1, wherein said plurality of recessed areas is of a shape to fit into a plurality of complementary recessed areas in the bottom of said container.

3. The dispensing device according to claim 1, wherein said dispenser disk is a circular disk.

4. The dispensing device according to claim 1, wherein said dispenser disk has a substantially rectangular shape.

5. The dispensing device according to claim 1, wherein said dispenser disk includes a plurality of concentric, annular-shaped recessed areas and a plurality of concentric, annular-shaped raised areas, each of said raised areas including a plurality of said dispensing outlets.

6. The dispensing device according to claim 1, wherein said dispenser disk comprises a plurality of radially extending raised areas spaced apart by a radially extending recessed area, each of said raised areas including a plurality of said dispensing outlets.

7. The dispensing device according to claim 1, wherein said dispenser disk is substantially non-flexible.

8. The dispensing device according to claim 1, wherein said dispenser disk includes a plurality of flexible tabs extending from an outer edge of said dispenser disk.

9. A container and dispensing device for delivering a viscous material, the combination comprising:

a substantially non-planar dispenser device disposed on the surface of said viscous material, said dispenser device comprising a substantially non-planar member having an outer edge complementing the shape of said side wall of said container, said non-planar member having a plurality of recessed areas and a plurality of raised areas, a plurality of holes in said raised areas defining outlets.

10. The container and dispensing device of claim 9, wherein the bottom wall of said container has a plurality of recessed areas, the recessed areas of said dispenser disk being the same shape as the recessed areas of the bottom of said container.

11. The carton and dispensing device of claim 9, wherein said recessed areas comprise a plurality of concentric, spaced apart annular recesses to define a plurality of annular raised areas, each of said annular raised areas including a plurality of holes therein.

12. The container and dispensing device of claim 9, wherein said plurality of recessed areas comprises a centrally located recess and a concentric annular recess to define an annular raised area between said centrally located recess and said concentric annular recess.

13. The container and dispensing device of claim 12, further comprising an outer recess defining a plurality of radially disposed areas in said upper surface extending from said annular area toward an outer edge of said dispenser, each of said radial areas including a plurality of holes therein.

14. The container and dispensing device of claim 13, wherein said plurality of holes in said radial areas are graduated in size and increase in diameter toward said outer edge.

15. The container and dispensing device of claim 9, wherein said dispenser includes a central raised area having at least one dispensing outlet, a first annular ring of spaced-apart recesses defining first raised areas therebetween, each said raised area having at least one dispensing outlet therein, and a second annular ring of spaced-apart recesses defining second raised areas, said second raised areas being arcuately staggered from said first recessed areas.

16. The container and dispensing device of claim 9, wherein said bottom wall of said container has a non-planar surface complementing said dispenser device.

17. The container and dispensing device of claim 9, wherein said dispenser device includes strengthening means for providing rigidity to said dispenser device.

* * * * *